United States Patent [19]

Haley

[11] 4,148,627

[45] Apr. 10, 1979

[54] AGGLOMERATION OF STEEL MILL WASTES

[75] Inventor: George D. Haley, Greenville, Pa.

[73] Assignee: R. C. Metals, Inc., Greenville, Pa.

[21] Appl. No.: 799,554

[22] Filed: May 23, 1977

[51] Int. Cl.[2] ..... B02C 18/28; C22B 1/243

[52] U.S. Cl. ..... 75/3; 75/256; 264/118; 264/140; 264/333

[58] Field of Search ..... 264/140, 144, 145, 118, 264/333; 75/3, 256; 266/137; 106/97

[56] References Cited

U.S. PATENT DOCUMENTS

| | | | |
|---|---|---|---|
| 2,540,173 | 2/1951 | Olivo | 75/256 |
| 2,614,828 | 10/1952 | Kelsey | 266/137 |
| 3,180,722 | 4/1965 | Swartz | 75/256 X |
| 3,316,081 | 4/1967 | Bratton | 75/3 |
| 4,063,944 | 12/1977 | Behring | 75/256 |

*Primary Examiner*—Thomas P. Pavelko
*Attorney, Agent, or Firm*—Thomas H. Murray

[57] ABSTRACT

A method for agglomerating particulate steel mill wastes such as roll scale and coke fines, and for utilizing the agglomerate in a metallurgical furnace. The wastes are mixed with Portland cement and cast into slabs which are thereafter broken and screened to a size which can be charged into a metallurgical furnace by automatic handling and weighing systems.

4 Claims, 1 Drawing Figure

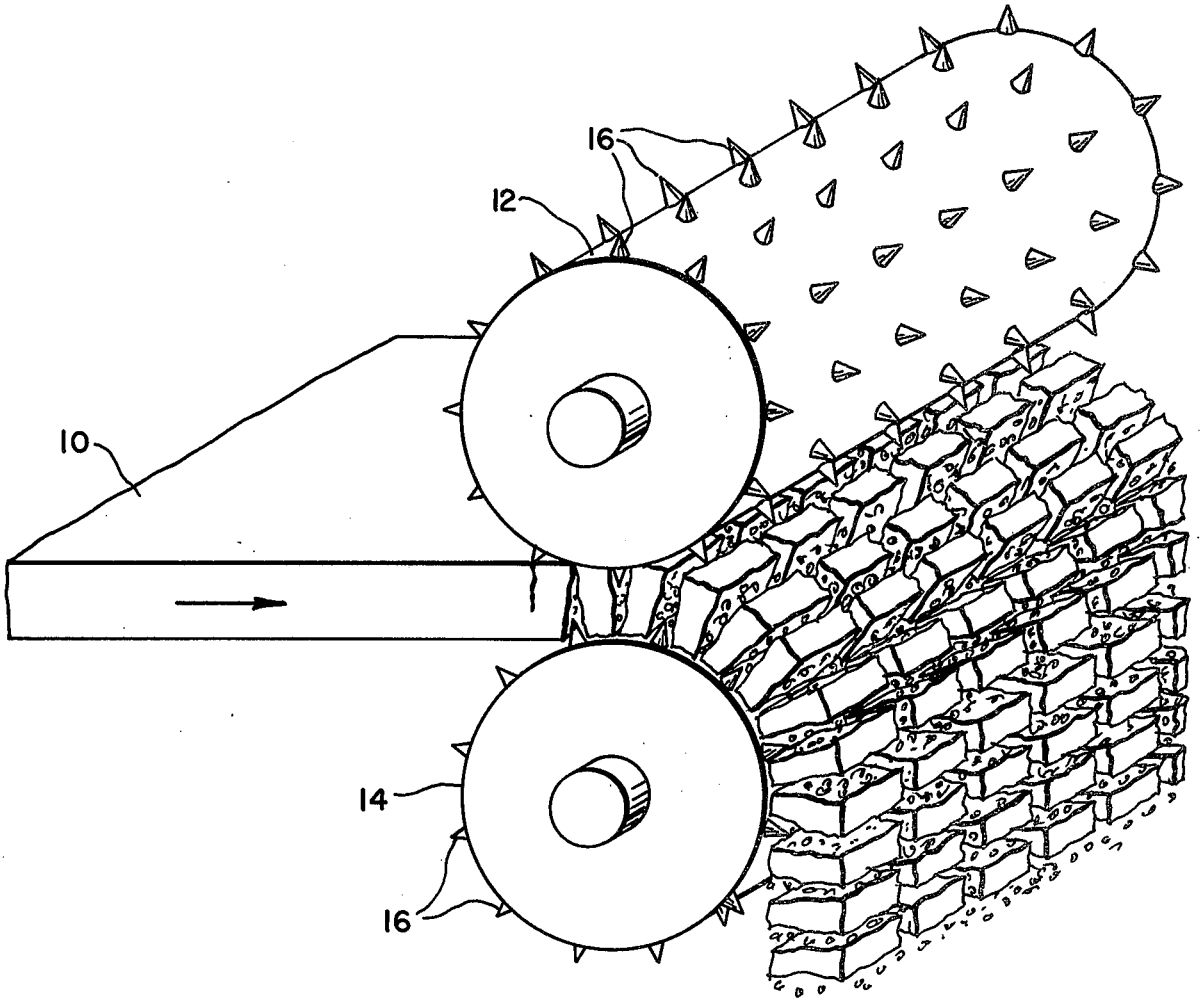
16
12
10
14
16

AGGLOMERATION OF STEEL MILL WASTES

BACKGROUND OF THE INVENTION

In the past, it has been common to sinter ferrous steel mill fines and wastes into agglomerates which are then charged into a blast furnace or cupola. The sintering process, however, is confined to fine particles which must be initially screened and requires a large capital investment for the sintering plant. In addition, it necessitates the use of large amounts of fuel and results in considerable pollution which must be eliminated or controlled by costly apparatus. Furthermore, in the sintering process, magnetite present in the wastes is oxidized to hematite, thus increasing oxygen content in the agglomerate which is undesirable. Briquetting and pelletizing of waste products have encountered similar problems.

In an effort to eliminate the necessity for sintering, various process have been provided which agglomerate waste materials with the use of a binder at low or ambient temperatures. Various binders have been utilized; however, most of these have definite disadvantages such as expense, water solubility or non-compatibility with blast-furnace melting.

SUMMARY OF THE INVENTION

In accordance with the present invention, a method is provided for agglomerating steel mill ferrous and carbonaceous wastes by the steps of mixing the wastes with water and Portland cement, pouring the mixture into a mold to form, after hardening of the cement, a slab having a thickness approximating the maximum dimension of the desired agglomerated fragments, and thereafter breaking the slab into fragments of desired size. The slab can be broken into fragments in a crusher; however, in order to minimize the creation of fines which must be recycled, it is preferable to form the fragments by passing the slabs through a flake breaker which effects a better fragmenting action than crushing.

The process of the invention has numerous advantages. First, the material to be agglomerated can be as coarse as one-half inch in diameter. This eliminates most need for any crushing or grinding of the steel mill waste material prior to agglomeration. The material to be agglomerated can contain moisture or oil and need not be dried; and the agglomeration can be accomplished without external heating at temperatures down to 20° F. Within twenty-four hours, the agglomerate will harden to 70% of its final strength without additional heating and without the use of specialized treatment. Consequently, the slabs from which the agglomerate is formed can be handled within twenty-four hours and broken into final size. After fracturing and sizing, the cut product can be charged into a furnace immediately or stored indefinitely outside in the weather. Freezing or rain has no effect on the finished product.

The above and other objects and features of the invention will become apparent from the following detailed description taken in connection with the accompanying single FIGURE drawing which schematically illustrates one manner in which the agglomerate of the invention can be formed from cement-bonded slabs.

In carrying out the invention, coke breeze, mill scale, precipitator dust, screened slag fines, filter cake, iron ore, ferroalloy ores and fines, for example, can be agglomerated either by themselves or as various mixtures. One successful agglomerate for use in a blast furnace is a mix having the following proportions:

| | |
|---|---|
| Roll Scale | 58% |
| Coke Breeze | 16% |
| Blast-Furance Precipitator Dust | 16% |
| Slag Fines | 10% |

This mixture is then mixed with Portland cement and water in the proportions:

| | Broad | Preferred |
|---|---|---|
| Waste Material | 80%–92% | 90% |
| Portland Cement | 5%–15% | 7% |
| Water | 2%–5% | 3% |

After mixing in a concrete mixer or the like, the material is then poured or fed into molds typically having a thickness of about $1\frac{1}{4}$ inches; although the thickness of the mold will vary between $\frac{1}{4}$ and $1\frac{1}{2}$ inches. This forms a slab which is removed from the mold and allowed to harden. Heat and moisture will accelerate the hardening and can be utilized but are not required. Thereafter, as shown in the drawing, the slab, indicated by the reference numeral 10, is passed through a flake breaker comprising opposing rolls 12 and 14 provided with projections or spikes 16 on their outer peripheries. In passing through the spiked rolls 12 and 14, the slab 10 is broken into fragments of the desired size. In this respect, if the maximum dimension of the fragments is 1 inch, for example, then the thickness of the slab 10 will be 1 inch. This minimizes the required crushing or breaking action and minimizes the generation of fines which must be recycled. Proper selection of the slab thickness can reduce the recycle from the sizing operation to less than 15%. The resulting product is then fed into a blast furnace or cupola by automatic weighing and handling systems. In the furnace, any moisture from the cement forms steam which has the desirable characteristic of protecting any alloying elements present from oxidation by carbon dioxide high up in the furnace. The resulting product can typically have a fragment size of about $1\frac{1}{4}'' \times \frac{1}{4}''$, although sizes up to $3'' \times \frac{1}{2}''$ have been produced.

Although the invention has been shown in connection with certain specific embodiments, it will be readily apparent to those skilled in the art that various changes in form and method steps can be made to suit requirements without departing from the spirit and scope of the invention.

I claim as my invention:

1. A method for agglomerating steel mill ferrous wastes comprising mixing said wastes with water and Portland cement, pouring the mixture into a mold to form, after hardening of the cement, a slab having a thickness no greater than the maximum dimension of the desired agglomerated fragments, and thereafter breaking said slab into fragments of desired size by passing it through a flake breaker which fractures said slab into fragments having a maximum dimension not greater than the thickness of said slab.

2. The method of claim 1 wherein said steel mill ferrous wastes are selected from the group consisting of, mill scale, precipitator dust, slag fines, filter cake, iron ore, ferroalloy ores and fines.

3. The method of claim 1 wherein the size of the agglomerated fragments is in the range of fragments having a maximum dimension of $\frac{1}{4}$ inch to $1\frac{1}{2}$ inches.

4. The method of claim 1 wherein said mixture comprises, by weight, 80%–92% waste material, 5%–15% Portland cement, and 2%–5% water.

* * * * *